US005180337A

United States Patent [19]

Rein

[11] Patent Number: 5,180,337

[45] Date of Patent: Jan. 19, 1993

[54] KITTY LITTER NOVELTY FIGURE

[76] Inventor: Eric Rein, 1327 Soria Glen, Escondido, Calif. 92026

[21] Appl. No.: 792,905

[22] Filed: Nov. 15, 1991

[51] Int. Cl.[5] ..... A63J 5/00

[52] U.S. Cl. ..... 472/57; 446/268; 446/491

[58] Field of Search ..... 446/268, 491, 321, 74; 472/70, 71, 57, 51; 40/538

[56] References Cited

U.S. PATENT DOCUMENTS 1,407,165 2/1922 Pajeau ..... 446/74
1,437,467 12/1922 Dykman ..... 446/74
2,175,319 10/1939 Rubenstein ..... 40/538 X
4,928,954 5/1990 Levine et al. ..... 446/268 X

FOREIGN PATENT DOCUMENTS 2500812 9/1982 France ..... 446/74

*Primary Examiner*—Mickey Yu
*Attorney, Agent, or Firm*—Ralph S. Branscomb

[57] ABSTRACT

A novelty item appearing to be a cat apparently trapped in a holding material that is cinched and tied at its upper portion depicting the cat was purposefully placed inside the material. The cat's tail protrudes from said material depicting attempted escape. The words KITTY LITTER printed on the material gives the comical effect that the cat is refuse.

4 Claims, 1 Drawing Sheet

KITTY LITTER NOVELTY FIGURE

BACKGROUND—FIELD OF INVENTION

The present invention relates to a novelty figure; more specifically the present invention relates to a comical novelty figure depicting a cat in a precarious situation.

BACKGROUND—DESCRIPTION OF PRIOR ART

There have been a number of novelty items particularly designed to portray cats in precarious situations such a figures that are attached to the windows of automobiles by suction cup means. Also, cats have been depicted as flat with a tire mark across their backs showing that they have been run over by an automobile. Another type of aesthetically pleasing novelty item depicting cats is U.S. Pat. 4,928,954 "Novelty Figure with Attachment Means" to Levine and Jaeger.

Although these are useful novelty items, they don't pertain to the present invention because said invention portrays a cat as being encased and depicted as refuse to be discarded.

INVENTION SUMMARY—OBJECTS AND ADVANTAGES

It is an object of the present invention to provide an improved novelty device.

It is another object of this invention to provide an improved novelty device having specific importance to persons who find humor in novelty figures depicting cats in precarious situations.

The foregoing objects can be accomplished by providing a cat figure encased in a refuse holding material such as burlap. This figure resembles a cat inside a material from which it cannot escape. The cat's tail protrudes from the material depicting an area it scratched open and its tail protrudes from the open area on the covering material. The top of the encasing material is gathered and tied with a common tying material such as twine depicting that the cat has been placed in the material purposefully. The top being cinched and tied reiterates the assumption the cat was purposefully placed in the material and is refuse. The words KITTY LITTER emblazoned on the encasing material gives credence to the present invention as being cat refuse. This also gives comical effect in that most humans recognize KITTY LITTER as a granular absorbative material that cats use for bodily functions and the present invention depicts the cat as said material.

DETAILED DESCRIPTION OF THE DRAWINGS

Figure 1:
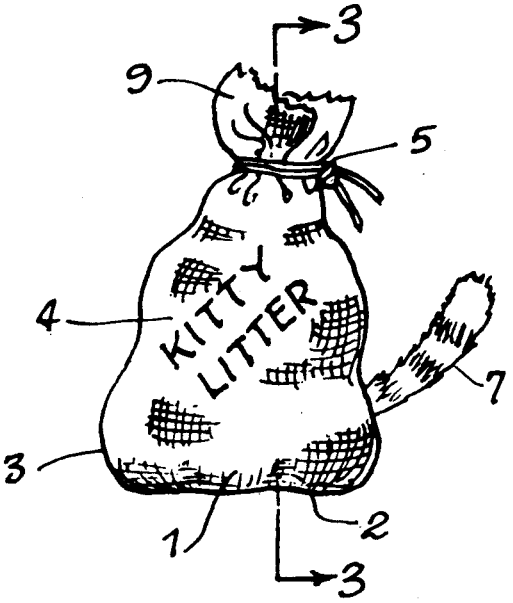
FIG. 1 is a front elevation of the present invention.

As shown in the drawings, the preferred KITTY LITTER NOVELTY FIGURE in accordance with the present invention includes an encasing material 1 which preferably is of inexpensive construction that can lend itself to slight expansion and contraction to manipulate the appearance of a trapped cat; such a material could be burlap. The base of said figure is flat enabling the figure to be free standing and negate the need for support 2.

The material 1 will demonstrate bulges and depressions to reflect extremities of the trapped cat attempting escape from the material such as 3.

Material 1 will be embossed with an indelible printing process that spells KITTY LITTER on the front of the present invention 4 in FIG. 1.

The material 1 will be gathered at 5 and cinched with a tying material such as twine. The material will be attached to 1 with a sewing process to fully enclose the material in 1 to give the appearance that the cat is trapped and cannot escape, apparent by the bulges of 3.

Figure 2:
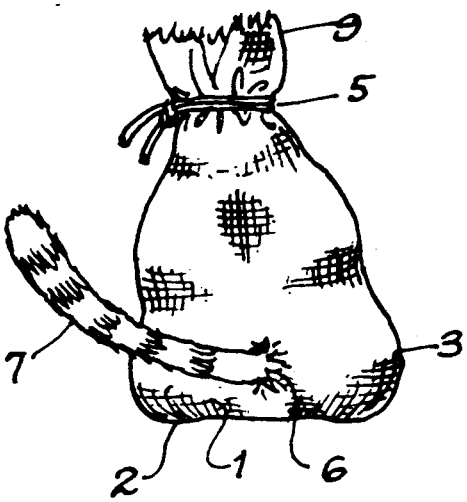
FIG. 2 is a rear elevation of the present invention.
Figure 4:
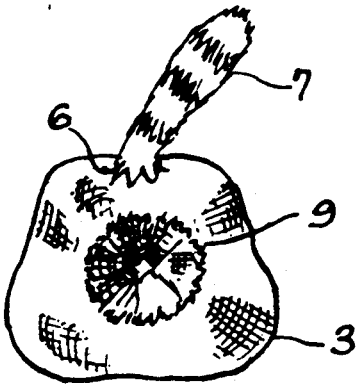
FIG. 4 is a top view of the present invention.

FIG. 2 and FIG. 4 reveal a hole that apparently was scratched open by the cat because it is haphazardly ripped and fragmented demonstrating the cat is seeking to escape as shown at 6.

FROM 6 the cat's tail protrudes from the body of said invention shown in 7. Said tail is attached to the soft pliable material of 8, preferably by a sewing means.

Figure 3:
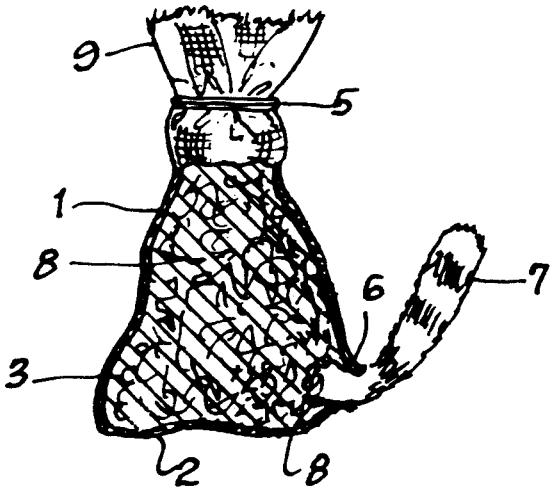
FIG. 3 is a fragmentary cross section of the present invention.

The figure in FIG. 1 is made of a pliable material while being filled with a soft pliable filling evident in FIG. 3 cross section 8. It is not necessary for 8 to depict a cat as users would identify; it will be depicted by the conformity through 1.

At the upper portion of the figure where it is gathered 5 the excess material will remain and be pliable and can be manipulated 9.

In the preferred embodiment the freestanding figure is approximately 7 to 10 inches in height and 4 to 6 inches wide. Such dimensions are desirable to enable the figure to stand without support and offer a more realistic appearing novelty figure to the user.

It is possible to use a number of different materials as the embodiment and tying material, which would remain pliable, allowing printing of the words KITTY LITTER and demonstrate the present invention. The previously mentioned materials are desirable because they represent household materials that are commonly used to discard refuse.

While the invention has been described with regards to the preferred embodiment, it is recognized that other variations may be made without departing from the concept of the present invention.

For example, different types of cat tails may be used to demonstrate different breeds and other body parts may be employed to base. A1.so the figure is preferred to be plush for each of manufacture and appearance, but molded or other means may be employed.

It is also possible to change the embossed lettering and tying material.

Different variations of the invention are possible such as smaller versions for key chains and pencil holders. The invention also could be hung from various objects or attached to said, such as rear view mirrors in automobiles.

What is claimed is:

1. A novelty item producing the impression of a cat trapped in a bag comprising;

(a) a bag;

(b) said bag being substantially completely enclosed; and, (c) a simulated cat tail attached to and extending from a portion of said bag such that the novelty item produces the visual impression that a cat has been captured in said bag such that only its tail protrudes.

2. Structure according to claim 1 wherein said bag is at least partially filled with a yielding, irregular lumpy mateiral that produces bulges in said bag which are visually apparent form outside the bag.

3. Structure according to claim 2 wherein said bag has an open top which is bunched together and tied together with twine to produce the appearance of a deliberate entrapment of a cat within said bag.

4. Structure according to claim 1 wherein said bag is constructed of burlap.

* * * * *